US006123332A

United States Patent [19]

Bowling

[11] Patent Number: 6,123,332

[45] **Date of Patent: *Sep. 26, 2000**

[54] RANDOM NUMBER GENERATOR FOR GAME PLAYING; AND METHODS

[76] Inventor: Michael A. Bowling, 7931 S. Avenida de Pina, Tucson, Ariz. 85747

[ * ] Notice: This patent is subject to a terminal disclaimer.

[21] Appl. No.: 09/344,842

[22] Filed: Jun. 28, 1999

Related U.S. Application Data

[63] Continuation of application No. 09/003,246, Jan. 6, 1998, Pat. No. 5,938,197.

[51] Int. Cl.[7] ..... A63B 71/00; A63F 1/00

[52] U.S. Cl. ..... 273/138.1; 273/146

[58] Field of Search ..... 273/138.1, 143 A, 273/146

[56] References Cited

U.S. PATENT DOCUMENTS

| | | | |
|---|---|---|---|
| D. 267,569 | 1/1983 | Polite . | |
| 1,271,551 | 7/1918 | Ebner et al. . | |
| 1,795,562 | 3/1931 | King et al. . | |
| 4,239,226 | 12/1980 | Palmer . | |
| 4,678,190 | 7/1987 | Dery | 273/146 |
| 5,150,900 | 9/1992 | Onzo . | |
| 5,203,562 | 4/1993 | Smith | 273/146 |
| 5,224,708 | 7/1993 | Gathman et al. . | |
| 5,690,331 | 11/1997 | Sides | 273/146 |

*Primary Examiner*—Steven Wong
*Assistant Examiner*—M. Chambers
*Attorney, Agent, or Firm*—Merchant & Gould P.C.

[57] ABSTRACT

A die construction includes a body having first and second, opposite end caps and an extension member therebetween. The extension member has a first number of discrete facets and no more than the first number. Each of the discrete facets is identically shaped and have equal surface areas. The first end cap has a second number of discrete facets and no more than the second number. The second number is one-half of the first number. Each of the first end cap discrete facets is identically shaped and has an equal surface area to one another. The second end cap has the second number of discrete facets, that is, the same number as the first end cap, and has no more than the second number. Each of the second end cap discrete facets is identically shaped as the first end cap discrete facets. Each of the second end cap discrete facets has a surface area equal to a surface area of each of the first end cap discrete facets.

20 Claims, 3 Drawing Sheets

RANDOM NUMBER GENERATOR FOR GAME PLAYING; AND METHODS

This application is a continuation of application Ser. No. 09/003,246, filed Jan. 6, 1998, now U.S. Pat. No. 5,938,197. Application Ser. No. 09/003,246 is incorporated by reference herein.

FIELD OF THE INVENTION

The present invention relates to devices for game playing. More particularly, the present invention relates to a random number generator for game playing. Specifically, the present invention relates to a die construction.

BACKGROUND OF THE INVENTION

There are numerous devices of different types that are useful for selecting at random a number, letter, or other character. Many of these are in the form of a die.

The traditional playing die is a cube-shaped, six-sided member. Through the years, dice of more than six sides have been developed, as the demand in various games of chance have necessitated. In U.S. Pat. No. 1,271,551 to Ebner, et al., a game die is disclosed in the form of an octagonal, rolling cylinder. U.S. Pat. No. 5,150,900 to Onzo discloses a heptahedron-shaped rolling cylinder for generating a random number.

Improvements are desirable.

SUMMARY OF THE INVENTION

The present invention is directed to a die construction that substantially obviates one or more of the problems due to the limitations and disadvantages of the prior art.

To achieve the advantages of the invention, and in accordance with the purposes of the invention, as embodied and broadly described herein, the invention comprises a die construction. The die construction includes a body having first and second, opposite end caps and an extension member therebetween. The extension member has a first number of discrete facets and no more than the first number. Each of the discrete facets is identically shaped and have equal surface areas. The first end cap has a second number of discrete facets and no more than the second number. The second number is one-half of the first number. Each of the first end cap discrete facets is identically shaped and has an equal surface area to one another. The second end cap has the second number of discrete facets, that is, the same number as the first end cap, and has no more than the second number. Each of the second end cap discrete facets is identically shaped as the first end cap discrete facets. Each of the second end cap discrete facets has a surface area equal to a surface area of each of the first end cap discrete facets.

Preferably, each of the extension member discrete facets includes printed indicia thereon. For example, this may take the form of a numbers or other markings, such as polka dots. The printed indicia indicate what number has been randomly generated.

In preferred arrangements, each of the extension member discrete facets is tapered. More preferably, each of the extension member discrete facets is triangular-shaped.

In certain preferred embodiments, each of the first and second end cap discrete facets is tapered. More preferably, each of the first and second end cap discrete facets is triangular-shaped.

In one preferred embodiment, the number of facets of the extension member is six. In such arrangements, the second number, that is, the number of discrete facets on the first end cap, is three. Three is also the number of discrete facets on the second end cap.

In other preferred arrangements, the number of facets of the extension member is 10, while the number of facets of each of the end caps is five.

In still other arrangements, the number of discrete facets of the extension member is 20, while the number of discrete facets for each of the end caps is 10.

Preferably, a ratio of a surface area of each of the extension member facets to a surface area of each of the first end cap discrete facets is about 2–3:1.

In preferred arrangements, the number of facets of the first end cap is equal to one-fourth of the total number of facets on the entire die construction. That is, the number of facets of the first end cap may be determined by totaling the number of facets of the first end cap plus the number of facets of the second end cap, plus the number of facets of the extension member and then dividing that total by four. In such arrangements, the first and second end caps have an equal number of facets.

It is to be understood that both the foregoing general description and the following detailed description are exemplary and explanatory only and are not restrictive of the invention, as claimed. The accompanying drawings, which are incorporated in and constitute a part of this specification, illustrate example embodiments of the invention and together with the description, serve to explain the principles of the invention.

DETAILED DESCRIPTION OF THE PREFERRED EMBODIMENTS

Figure 3:
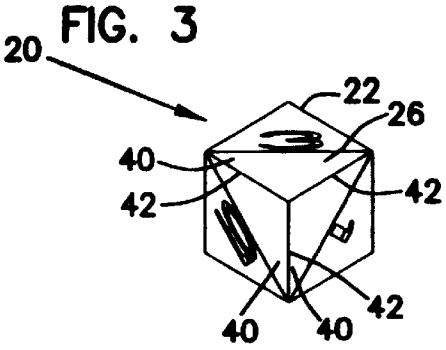
FIG. 3 is an end view opposite of the FIG. 2 end view, embodying the present invention.

Reference will now be made in detail to the present preferred embodiments of the invention, examples of which are illustrated in the accompanying drawings.

In accordance with the invention, the invention is directed to a die construction. As embodied herein, a first embodiment of a die construction is shown generally in FIGS. 1–5 at 20. Die 20 includes a body construction 22 with a pair of opposite end members or end caps 24, 26. In extension between first and second end caps 24, 26 is a display member or extension member 28.

Extension member 28 functions to display indicia such as polka dots, or numbers or digits 30. The indicia 30 displayed is indicative of the number generated after rolling die construction 20.

The extension member 28 includes a plurality of discrete facets 32. Preferably, each of the discrete facets 32 are identically shaped and have equal surface areas to each other. That is, each of facets 32 has a surface area which is equal to and no greater and no less than the surface area of any other of the facets 32. Each of facets 32 is angled relative to an adjacent facet 32 to define corner or edge surfaces 34. Each of facets 32 is angled relative to its adjacent facet 32 at an equal angle as every other angle between facets 32. In this particular embodiment, there are six facets 32 and no more than six facets. That is, in the embodiment illustrated in FIGS. 1–5, extension member 28 consists essentially of six facets 32. The angle between adjacent facets 32 is, therefore, 60°. That is, the angle between each adjacent facet 32 is equal to 360° divided by the total number of facets in the extension member 28. Because there are a total number of six facets 32 in extension member 28, the angle between each adjacent facet 32 is 360° divided by six, which is 60°.

Preferably, each of the extension member facets 32 is configured and arranged to display clear, readable indicia. In particular, the shape of each of facets 32 is advantageous over existing die constructions in that facets 32 allow for the display of a larger, more legible number or indicia 30. While a variety of working embodiments are contemplated, in the illustrated embodiment, facets 32 have a tapered shape and configuration. That is, facets 32 are not rectangular. Preferably, facets 32 are triangular-shaped. That is, facets 32 have no more than three sides, each side being a straight edge. In other words, facets 32 are defined by, and bordered by, an outer periphery, which consists essentially of three straight sides. This provides for a triangular-shaped facet 32.

Figure 2:
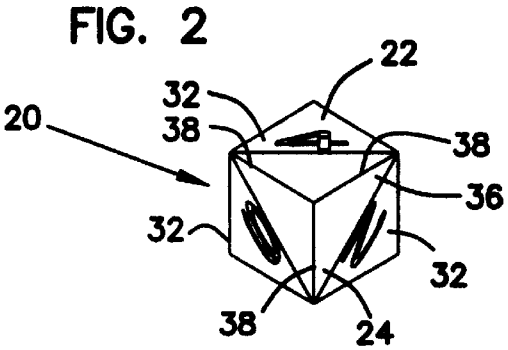
FIG. 2 is an end view of the die of FIG. 1, embodying the present invention.
Figure 4:
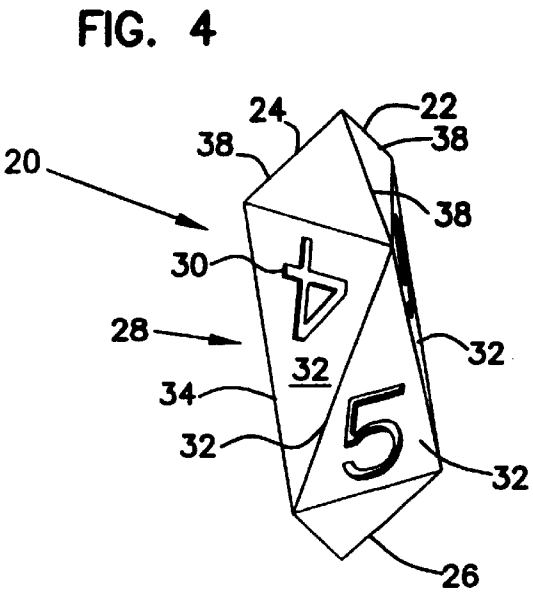
FIG. 4 is a perspective view of the FIG. 1 embodiment, embodying the present invention.
Figure 5:
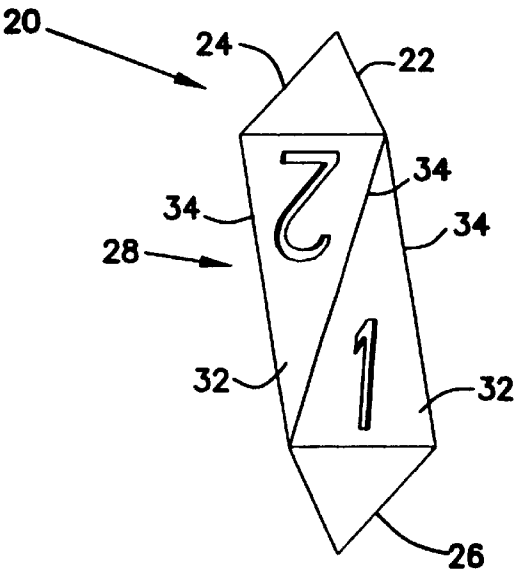
FIG. 5 is a side elevational view of the die of FIG. 1, embodying the present invention.

In reference now to FIG. 2, the first end cap 24 is illustrated. The first end cap 24 includes a plurality of discrete facets 36. In particular, first end cap 24 includes one-half of the number of facets of the extension member 28. In the illustrated embodiment, the extension member 28 has six facets 32. Therefore, the first end cap has three discrete facets, and no more than three facets 36. In other words, first end cap 24 consists essentially of three facets 36. Stated another way, the ratio of the number of facets of the extension member to the number of facets of the first end cap is 2:1.

Each of the first end cap facets 36 is identically shaped to every other facet 36 of the first end cap. Further, each of the first end cap facets 36 has a surface area equal to the surface area of every other facet 36 of the first end cap 24.

Each of the first end cap facets 36 is angled relative to an adjacent end cap facet 36 to define corner or edge surfaces 38 therebetween. In the particular embodiment illustrated, each of facets 36 is angled relative to its adjacent facet 36 by an angle of 120°. That is, the angle between adjacent facets 36 is equal to 360° divided by the number of facets, in this case, three. Further, the angle between adjacent facets 36 of the first end cap 24 is equal to two times or twice the angle between adjacent facets 32 of the extension member 28. Stated another way, the ratio of the angle between adjacent facets 32 in the extension member to the angle between adjacent facets 36 in the first end cap 24 is 1:2.

Each of the first end cap facets 36 is non-rectangular and non-circular. Specifically, each of the first end cap facets 36 is tapered. In the particular embodiment illustrated, each of the first end cap facets 36 is triangular-shaped. That is, each of the first end cap facets is defined by, or bordered by, a periphery of three connected straight edges. In this way, the first end cap facets 36 are defined by a triangular border, consisting essentially of three straight edges.

In reference now to FIG. 3, the second end cap 26 is illustrated. Second end cap 26 is shaped identically to the first end cap 24. That is, second end cap 26 includes three discrete facets 40, identically shaped to each other, and identically shaped as first end cap facets 36. As with the first end cap 24, the second end cap 26 has the three facets 40, and has no more than the three facets 40. Also as with the first end cap 24, the second end cap 26 includes half of the number of facets as the number of facets 32 of the extension member 28, i.e., the ratio of facets of the extension member 28 to facets of the second end cap 26 is 2:1.

Second end cap facets 40 are angled relative to adjacent facets 40 to define corners or edges 42 therebetween. As with the first end cap 24, the second end cap 26 is arranged such that the angle between adjacent facets 40 is equal to 360° divided by the number of facets (three, in the illustrated example). Therefore, second end cap facets 40 define an angle of 120° with the adjacent second end cap facet 40.

As mentioned above, second end cap facets 40 are identical in shape and appearance to first end cap facets 36, in the illustrated embodiment. As such, second end cap facets 40 are tapered. In particular, second end cap facets 40 are triangular-shaped, preferably having three non-curved, straight sides.

Figure 1:
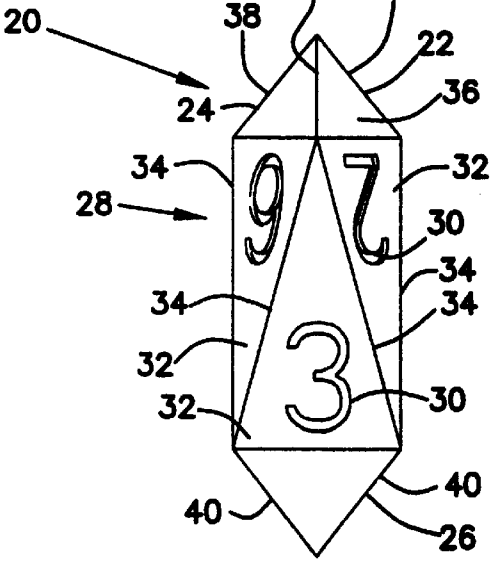
FIG. 1 is a top plan view of a first embodiment of a die, embodying the present invention.

Referring again to FIG. 1, it can be seen that first end cap facets 36 are out of phase with second end cap facets 40. That is, the first end cap facets 36 are oriented relative to the second end cap facets 40 in an unsynchronized manner; they are not in correlation with each other. As can be seen in FIG. 1, one total facet 40 of the second end cap 26 is visible, while, in the same view, two skewed views of facets 36 of the first end cap 24 are visible.

The inventor has discovered that the configuration of the die 20 is advantageous. In particular, the shape of the end caps 24, 26 provides for more bounce when dropping die 20 onto a surface. That is, to generate a random number, the user holds die 20 above a surface at a sufficient distance, such that when die 20 is dropped onto the surface, die 20 rolls before eventually resting upon one of the facets 32 of the extension member 28. The number or indicia 30 displayed on the facet 32 which is in the uppermost position is the number which has been randomly generated. The shapes of the end caps 24, 26 provide for more bounce and randomness when die 20 is dropped onto a surface. The tapered, triangular shapes of end caps 24, 26 provide for surfaces which can abut and engage the surface on which die 20 is being dropped, to create a more interesting and amusing outcome.

Die 20 is constructed such that the center of mass of die 20 is in the precise center of symmetry of die 20. By "center of symmetry", it is meant a point that is related to a geographical figure in such a way that for any point on the figure, there is another point on the figure such that a straight line joining the two points is bisected by the original point.

Each of the surface areas of discrete facets 32 of extension member 28 are equal. The combination of the center of symmetry being the center and the equal surface areas of facets 32 provides for a fair playing die. That is, no one facet 32 is more likely to be rolled than any other of the facets 32.

Preferably, each of the facets 32 has a surface area of about 0.0089 to 0.89 sq. in., typically about 0.089 sq. in. Preferably, each of the first end cap facets 36 has a surface area of about 0.0033 to 0.33 sq. in., typically about 0.033 sq. in. As such, the ratio of the surface area of the extension member facets 32 to the surface area of each of the first end cap facets 36 is about 2.7:1. The second end cap facets 40 are identical to the first end cap facets 36. Therefore, the second end cap facets 40 each have a surface area of about 0.0033 to 0.33 sq. in., typically about 0.033 sq. in. The ratio of the surface area of the facets 32 of the extension member 28 to the surface area of each of the second end cap facets 40 is about 2.7:1.

Die 20 is useful for generating a random number. In the illustrated embodiment, there are six discrete facets 32 on the extension member 28. Each of the facets 32 has indicia 30 thereon, and in the illustrated embodiment, this indicia 30 is a numerical integer from one to six, inclusive. Upon shaking or rolling the die 20, die 20 will bounce and roll around, before landing on one of its facets 32. The facet 32 in the up position indicates the number which has been generated.

It should also be noted that the number of discrete facets 36 of the first end cap 24 is equal to one-fourth of the total number of discrete facets on the die 20. The total number of facets on die 20 is equal to the number of facets 32 of the extension member 28, plus the number of facets 36 of the first end cap 24, plus the number of facets 40 of the second end cap 26. In the embodiment of FIGS. 1–5, there are total of 12 facets (six plus three plus three=12). The number of facets on the first end cap 24 is equal to twelve divided by four, which is three. Analogously, the number of facets 40 of the second end cap 26 is equal to one-fourth of the total number of facets of the die 20. The total number of facets of the first embodiment of FIGS. 1–5 is 12. Therefore, the number of facets of the second end cap 40 is three (12/4=3).

Preferably, the die 20 is constructed from any rigid material which holds its shape. Examples of suitable materials include glass, crystalline structure, and plastic.

Attention is now directed to FIGS. 6–9. In FIGS. 6–9, a second embodiment of a die is shown generally at 50. Die 50 is constructed analogously to die 20. That is, die 50 includes a first end cap 52, a second end cap 54, and an extension member 56 in extension therebetween. In this embodiment, however, extension member 56 defines 10, and no more than 10, discrete facets 58.

Each of facets 58 includes indicia 60 thereon, indicating a number. As with the first embodiment, facets 58 of die 50 are tapered in order to more clearly display indicia 60. In particular, facets 58 are triangular-shaped.

First end cap 52 is constructed analogously to first end cap 24. First end cap 52 includes a number of facets 62, which is equal to one-half of the number of facets 58 of the extension member 56. Specifically, first end cap 52 has five discrete facets 62, and no more than five facets 62. First end cap facets 62 are triangular-shaped. Each of first end cap facets 62 is angled relative to an adjacent end cap facet 62 to define an angle of 72° between each.

Second end cap 54 is identical to first end cap 52. Second end cap 54 has five discrete facets 64. Each of facets 64 is triangular in shape, and is angled 72° with respect to an adjacent facet 64.

As similarly described with respect to the first embodiment, in this embodiment the facets 62 on the first end cap 52 are out of phase with the facets 64 on the second end cap 54.

Preferably, the surface area of each of facets 58 of extension member 56 is about 0.0106 to 1.06 sq. in., typically about 0.106 sq. in. The surface area of each of first end cap facets 62 is about 0.0046 to 0.46 sq. in., typically about 0.046 sq. in. Second end cap facets 64 are identical to first end cap facets 62. As such, each of second end cap facets 64 has a surface area of about 0.0046 to 0.46 sq. in., typically about 0.046 sq. in. The ratio of the surface area of one facet 58 to one facet 62 is about 2.3:1. This is the same ratio as the ratio of facet 58 to facet 64.

As with the first embodiment of the die, die 50 is constructed so that the center of mass is in the precise geometric center of die 50. Further, each of facets 58 has an identical and equal surface area. This provides for a fair playing die.

Die 50 has a total of 20 facets. That is, extension member 56 has ten facets, first end cap has five facets, and second end cap has five facets. Therefore, the total number of facets is: 10+5+5=20. The number of facets of each of the first and second end caps 52, 54 is equal to one-fourth of the total number of facets of die 50. Thus, since there are a total of 20 facets, the number of facets of first end cap 52 can be derived by dividing by four, which is five. Analogously, the number of facets of the second end cap 54 may be derived by dividing the total number of facets (20) by four, which is five.

Die 50 is used analogously as die 20. That is, die 50 is dropped at a height above a surface sufficient to cause die 50 to roll around. Ultimately, die 50 will rest upon one of its extension member facets 58. This will leave one of its extension member facets 58 in the uppermost position. The number displayed on the facet in the uppermost position is the number generated. In the example illustrated, this would be an integer from 1 through 10, inclusive.

Attention is now directed to FIGS. 10–13. In FIGS. 10–13, a third embodiment of a die is shown generally at 70. Die 70 is constructed analogously to die 20 and die 50. That is, die 70 includes a first end cap 72, a second end cap 74, and an extension member 76 in extension therebetween. In this embodiment, however, extension member 76 defines 20, and no more than 20, discrete facets 78.

Each of facets 78 includes indicia 80 thereon, indicating a number. As with the first and second embodiments, facets 78 of die 70 are tapered in order to more clearly display indicia 80. In particular, facets 78 are triangular-shaped.

Figure 6:
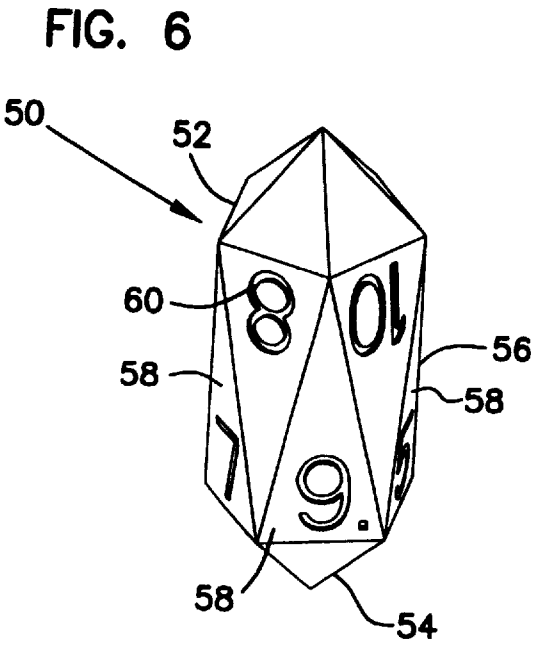
FIG. 6 is a perspective view of a second embodiment of a die construction, embodying the present invention.
Figure 7:
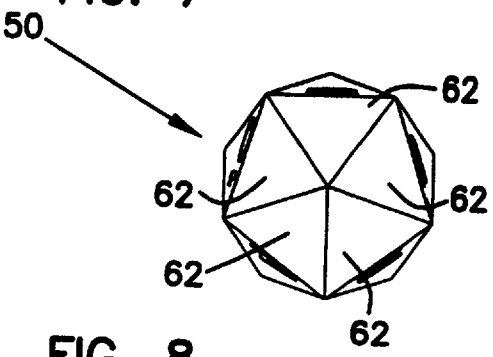
FIG. 7 is an end view of the die of FIG. 6, embodying the present invention.
Figure 8:
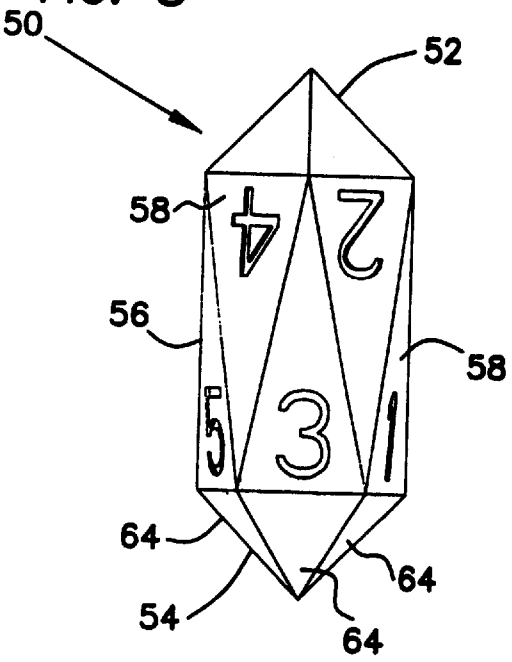
FIG. 8 is a side elevational view of the die of FIG. 6, embodying the present invention.
Figure 9:
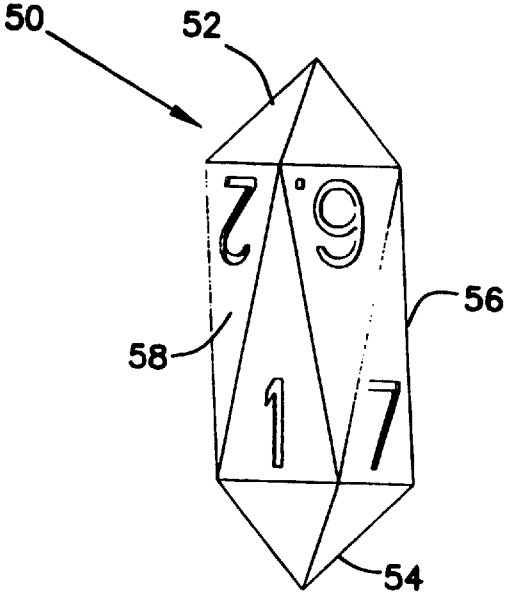
FIG. 9 is a side elevational view of the die construction of FIG. 6, embodying the present invention.
Figure 10:
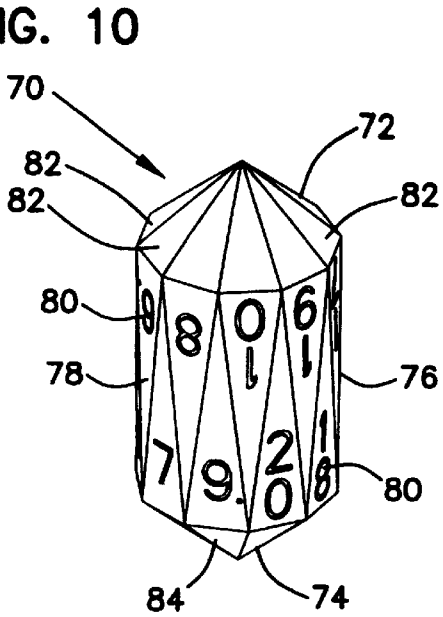
FIG. 10 is a perspective view of a third embodiment of a die construction, embodying the present invention.
Figure 11:
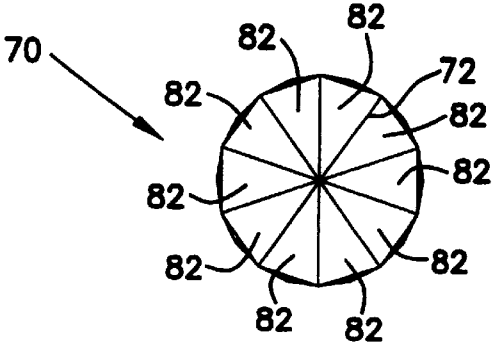
FIG. 11 is an end view of the die construction depicted in FIG. 10, embodying the present invention.
Figure 12:
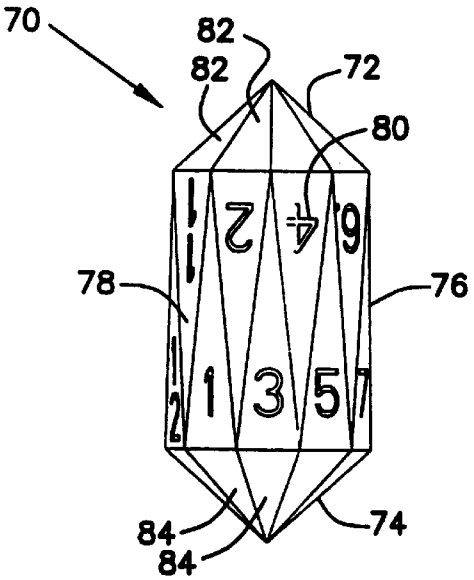
FIG. 12 is a side elevational view of the die construction depicted in FIG. 10, embodying the present invention.
Figure 13:
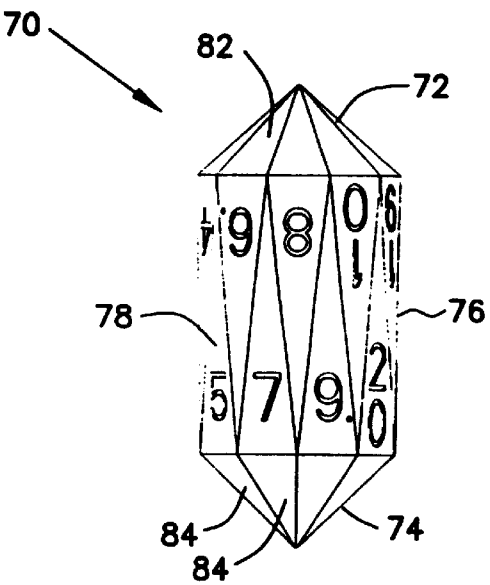
FIG. 13 is a side elevational view, similar to that depicted in FIG. 12, but rotated, embodying the present invention.

First end cap 72 is constructed analogously to first end cap 24 (FIG. 1) and first end cap 52 (FIG. 6). First end cap 72 includes a number of facets 82, which is equal to one-half of the number of facets 78 of the extension member 76. Specifically, first end cap 72 has ten discrete facets 82, and no more than ten facets 82. First end cap facets 82 are triangular-shaped. Each of first end cap facets 82 is angled relative to an adjacent end cap facet 82 to define an angle of 36° between each.

Second end cap 74 is identical to first end cap 72. Second end cap 74 has ten discrete facets 84. Each of facets 84 is triangular in shape, and is angled 36° with respect to an adjacent facet 84.

As described with respect to the first and second embodiments, in this embodiment, the facets 82 on the first end cap 72 are out of phase with the facets 84 on the second end cap 74.

Preferably, the surface area of each of facets 78 of extension member 76 is about 0.0116 to 1.16 sq. in., typically about 0.116 sq. in. The surface area of each of first end cap facets 82 is about 0.0056 to 0.56 sq. in., typically about 0.056 sq. in. Second end cap facets 84 are identical to first end cap facets 82. As such, each of second end cap facets 84 has a surface area of about 0.0056 to 0.56 sq. in., typically about 0.056 sq. in. The ratio of the surface area of one facet 78 to one facet 82 is about 2.06:1. This is the same ratio as the ratio of facet 78 to facet 84.

As with the first and second embodiments of the die, die 70 is constructed so that the center of mass is in the precise geometric center of die 70. Further, each of facets 78 has an identical and equal surface area. This provides for a fair playing die.

Die 70 has a total of 40 facets. That is, extension member 76 has twenty facets, first end cap has ten facets, and second end cap has ten facets. Therefore, the total number of facets is: 20+10+10=40. The number of facets of each of the first and second end caps 72, 74 is equal to one-fourth of the total number of facets of die 70. Thus, since there are a total of 40 facets, the number of facets of first end cap 72 can be derived by dividing by four, which is ten. Analogously, the number of facets of the second end cap 74 may be derived by dividing the total number of facets (20) by four, which is ten.

Die 70 is used analogously as die 20 and die 50. That is, die 70 is dropped at a height above a surface sufficient to cause die 70 to roll around. Ultimately, die 70 will rest upon one of its extension member facets 78. This will leave one of its extension member facets 78 in the uppermost position. The number displayed on the facet in the uppermost position is the number generated. In the example illustrated, this would be an integer from b 1through 20, inclusive.

Other embodiments of the invention will be apparent to those skilled in the art from consideration of the specification and practice of the invention disclosed herein. In particular, one skilled in the art will understand that die constructions having extension member facets totaling 8, 12, 30 and other even multiples can be constructed according to the principles taught herein.

It is intended that the specification and examples be considered as exemplary only, with a true scope and spirit of the invention being indicated by the following claims.

I claim:

1. A die construction comprising:

(a) a body having first and second, opposite end caps and an extension member therebetween;

(b) said extension member having six discrete facets and no more than six;

(i) each of said discrete facets being identically shaped and having equal surface areas;

(c) said first end cap having three discrete facets and no more than three;

(i) each of said first end cap discrete facets being identically shaped and having equal surface areas;

(d) said second end cap having three discrete facets and no more than three;

(i) each of said second end cap discrete facets being shaped identically as said first end cap discrete facets; and each of said second end cap discrete facets having a surface area equal to a surface area of each of said first end cap discrete facets;

(e) each of said discrete facets of said extension member having a surface area of between 0.0089–0.89 sq. in.;

(f) each of said discrete facets of said first and second end caps having a surface area different from the surface area of each of said discrete facets of said extension member;

(i) each of said first end cap discrete facets and said second end cap discrete facets having a surface area of between 0.0033–0.33 sq. in.

2. A die construction according to claim 1 wherein:

(a) each of said extension member discrete facets includes printed indicia thereon.

3. A die construction according to claim 2 wherein:

(a) said printed indicia includes a numeric integer.

4. A die construction according to claim 1 wherein:

(a) each of said extension member discrete facets is tapered.

5. A die construction according to claim 1 wherein:

(a) each of said extension member discrete facets is triangular-shaped.

6. A die construction according to claim 1 wherein:

(a) each of said first end cap discrete facets and said second end cap discrete facets is tapered.

7. A die construction according to claim 1 wherein:

(a) each of said first end cap discrete facets and said second end cap discrete facets is triangular-shaped.

8. A die construction according to claim 1 wherein:

(a) each of said extension member discrete facets is triangular-shaped;

(i) each of said discrete facets of said extension member having a surface area of about 0.089 sq. in.;

(b) each of said first end cap discrete facets and said second end cap discrete facets is triangular-shaped; and (i) each of said first end cap discrete facets and said second end cap discrete facets having a surface area of about 0.033 sq. in.

9. A die according to claim 1 wherein:

(a) each of said first end cap discrete facets is out of phase with said second end cap discrete facets.

10. A die according to claim 1 wherein:

(a) said body has a center of mass that is also a center of symmetry.

11. A die comprising:

(a) a body including a first end cap, a second end cap, and an extension member in extension therebetween;

(b) said first end cap including three facets and no more than three; said second end cap including three facets and no more than three; and said extension member defining six facets and no more than six;

(i) each of said extension member facets being equal in surface area;

(ii) each of said extension member facets being triangular-shaped;

(iii) each of said extension member facets having indicia thereon indicating a number;

(iv) each of said first end cap facets being triangular shaped;

(v) each of said second end cap facets being triangular shaped; and (vi) each of said extension member facets having a surface area that is different from a surface area of each of said first and second end cap facets.

12. A die according to claim 11 wherein:

(a) each of said indicia is a numerical integer.

13. A die according to claim 11 wherein:

(a) a ratio of a surface area of each of said extension member facets to a surface area of each of said first end cap discrete facets is about 2–3:1.

14. A die according to claim 11 wherein:

(a) each of said discrete facets of said extension member has a surface area of between 0.0089–0.89 sq. in.

15. A die according to claim 11 wherein (a) each of said first end cap discrete facets and said second end cap discrete facets has a surface area of between 0.0033–0.33 sq. in.

16. A die according to claim 11 wherein:

(a) each of said first end cap facets is out of phase with said second end cap facets.

17. A die according to claim 16 wherein:

(a) said body has a center of mass that is also a center of symmetry.

18. A method for generating a random number in a game; the method comprising:

(a) providing a die having:

(i) a body having first and second, opposite end caps and an extension member therebetween;

(ii) the extension member having a first number of discrete facets and no more than the first number; said first number of discrete facets being greater than zero;

(A) each of the discrete facets being identically shaped and having equal surface areas;

(B) each of the discrete facets having indicia representing a different number;

(iii) the first end cap having a second number of discrete facets and no more than the second number; the second number being one-half of the first number;

(iv) each of the first end cap discrete facets being identically shaped and having equal surface areas;

(v) the second end cap having the second number of discrete facets and no more than the second number;

(vi) each of the second end cap discrete facets being shaped identically as the first end cap discrete facets; and each of the second end cap discrete facets having a surface area equal to a surface area of each of the first end cap discrete facets;

(vii) each of the discrete facets of the first and second end caps having a surface area different from the surface area of each of the discrete facets of the extension member; and (b) dropping the die on a surface such that one of the discrete facets of the extension member eventually rests against the surface.

19. A method according to claim 18 wherein:

(a) said step of providing a die includes providing a die wherein the first number is six, and the second number is three.

20. A method according to claim 19 wherein:

(a) said step of providing a die includes providing a die wherein:

(i) each of the first end cap discrete facets is out of phase with each of the second end cap discrete facets;

(ii) each of the extension member discrete facets is tapered; and (iii) each of the first end cap discrete facets and the second end cap discrete facets is tapered.

* * * * *